United States Patent [19]

Suzuki et al.

[11] Patent Number: 4,515,131

[45] Date of Patent: May 7, 1985

[54] FUEL-INJECTION CONTROL IN AN INTERNAL-COMBUSTION ENGINE

[75] Inventors: Yukio Suzuki; Kunihiko Sato; Motoyasu Muramatsu, all of Toyota, Japan

[73] Assignee: Toyota Jidosha Kabushiki Kaisha, Toyota, Japan

[21] Appl. No.: 445,991

[22] Filed: Dec. 1, 1982

[30] Foreign Application Priority Data

Mar. 30, 1982 [JP] Japan ..... 57-50117

[51] Int. Cl.[3] ..... F02M 51/00

[52] U.S. Cl. ..... 123/491; 123/179 L; 123/414; 123/643

[58] Field of Search ..... 123/491, 179 L, 414, 123/643

[56] References Cited

U.S. PATENT DOCUMENTS

| | | | |
|---|---|---|---|
| 4,338,903 | 7/1982 | Bollinger | 123/414 |
| 4,365,602 | 12/1982 | Stiller et al. | 123/643 |
| 4,436,073 | 3/1984 | Miyagi | 123/179 L |
| 4,438,748 | 3/1984 | Ikeura et al. | 123/179 L |

FOREIGN PATENT DOCUMENTS

| | | | |
|---|---|---|---|
| 151128 | 11/1980 | Japan | 123/491 |

*Primary Examiner*—Parshotam S. Lall

*Attorney, Agent, or Firm*—Cushman, Darby & Cushman

[57] ABSTRACT

In a method and apparatus for controlling fuel injection in an internal-combustion engine, crankshaft angle signals and cylinder discrimination signals are produced by a crankshaft angle sensor, and the signal for execution of the first injection of fuel is calculated in a control circuit on the basis of the crankshaft angle signals and the cylinder discrimination signals so that the first explosion of the air-fuel mixture takes place within one rotation of the crankshaft of the engine.

4 Claims, 6 Drawing Figures

(1) CRANK ANGLE
(2) CRANK ANGLE SIGNAL N
(3) CYLINDER DISCRIM. SIGNAL G
(4) 1ST CYLINDER
(5) 5TH CYLINDER
(6) 3RD CYLINDER
(7) 6TH CYLINDER
(8) 2ND CYLINDER
(9) 4TH CYLINDER
(10)
(11)
(12)
0
180°
360°
480°
G(1)
G(2)
INTK
IG
IG
IG
CR(10)
FU(10)
EX(10)
t1
CR(11)
FU(11)
EX(11)
t2
CR(12)
FU(12)
EX(12)
t3
t4

FUEL-INJECTION CONTROL IN AN INTERNAL-COMBUSTION ENGINE

BACKGROUND OF THE INVENTION

1. Field of the Invention

The present invention relates to a method and an apparatus for controlling fuel infection in an internal-combustion engine. The method and apparatus of the present invention is used for an automobile internal-combustion engine.

2. Description of the Prior Art

In general, at the start of operation of an internal-combustion engine of the electronic fuel-injection control type, the first injection of fuel is carried out after the generation of the cylinder discrimination signal, which is produced in the crank angle sensor once for every rotation of the engine. However, the timing of the generation of the cylinder discrimination signal is not a fixed one; rather, it is within the range of one rotation of the crankshaft. Hence, there is a problem in that the timing of the starting of operation of the engine is not fixed and, therefore, a delay in the starting of operation of the engine can occur, the delay most in the worst case being for one rotation of the crankshaft.

SUMMARY OF THE INVENTION

It is the main object of the present invention to provide an improved method and apparatus for controlling fuel injection in an internal-combustion engine in which the period from the starting of cranking of the engine to the first explosion of the air-fuel mixture is reduced and, hence, to realize prompt and stable starting of operation of the internal-combustion engine.

In accordance with the fundamental aspect of the present invention, there is provided a method for controlling fuel injection in an internal-combustion engine, comprising the steps of: producing crankshaft angle signals and cylinder discrimination signals with a crankshaft angle sensor, carrying out a determination of the generation of the signal for execution of the first injection of fuel on the basis of the produced crankshaft angle signals and the produced cylinder discrimination signals, and performing the first injection of fuel in accordance with the first crankshaft angle signal after the starting of cranking of the engine by using the result of the determination, whereby the first explosion of the air-fuel mixture takes place within one rotation of the crankshaft of the engine.

DETAILED DESCRIPTION OF THE PREFERRED EMBODIMENT

Figure 1:
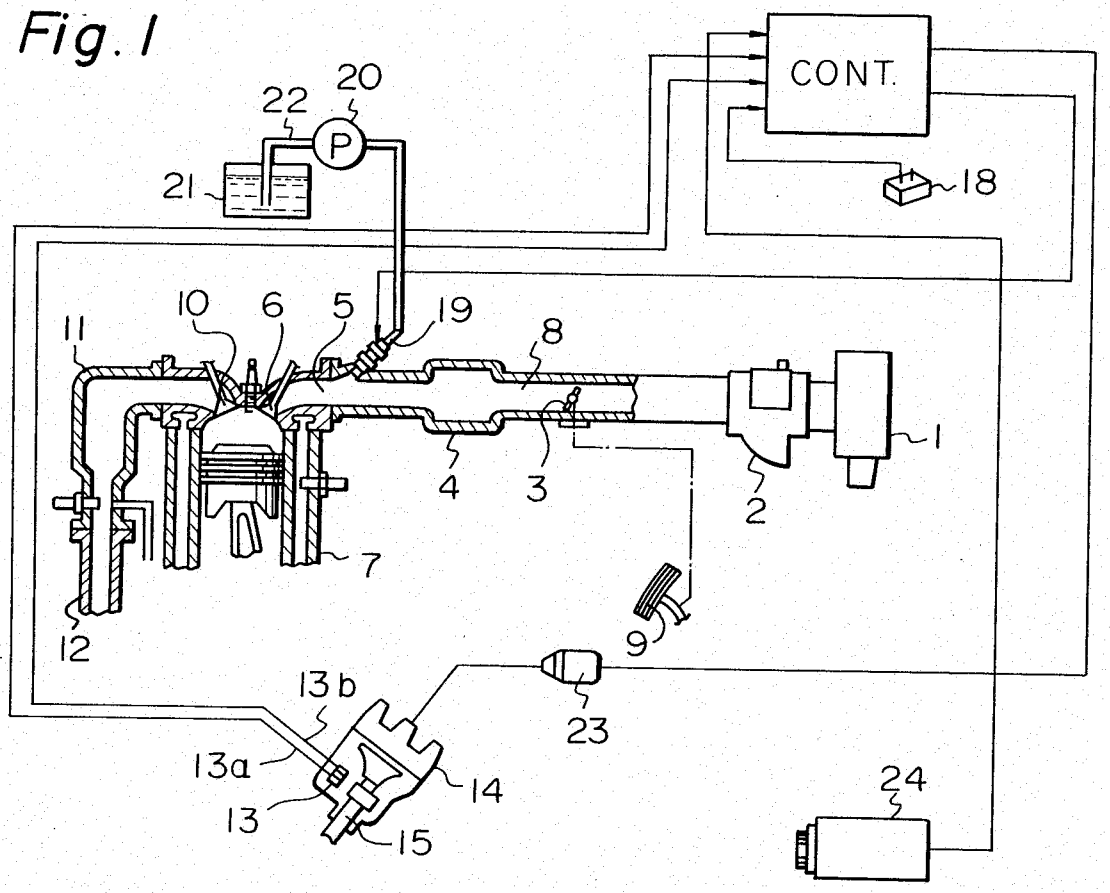
FIG. 1 illustrates an apparatus for controlling fuel injection in an internal-combustion engine according to an embodiment of the present invention.

The apparatus for controlling fuel injection in an internal-combustion engine according to an embodiment of the present invention, illustrated in FIG. 1, includes an air cleaner 1, an airflow meter 2, a throttle valve 3, an acceleration pedal 9, an air-intake pipe 8, a surge tank 4, a fuel-intake port 5, a fuel-injection valve 19, a fuel-injection pump 20, a fuel path 22, a fuel tank 21, an engine body 7, a fuel-intake valve 6, an exhaust valve 10, an exhaust manifold 11, an exhaust pipe 12, an ignition coil 23, a distributor 14 having a shaft 15, a crankshaft angle sensor 13 coupled with the shaft 15, a starter 24, a control circuit CONT, and a battery 18.

The air is taken in through the air cleaner 1 and the airflow meter 2 and is led to the air-intake pipe 8, where the throttle valve 3 and the surge tank 4 are provided. The air led to the air-intake pipe 8 is mixed with the fuel injected from the fuel-injection valve 19 at the fuel-intake port 5, and the gas, consisting of a mixture of air and fuel, is supplied to the combustion chamber of the engine body 7 when the fuel-intake valve 6 is opened. The combusted gas is led to the exhaust manifold 11 when the exhaust valve 10 is opened and then is exhausted from the exhaust pipe 12.

The signal ST representing the starting of the engine, supplied from the starter 24, the crankshaft angle signal N corresponding to the rotational speed of the engine, supplied through line 13*a* from the crankshaft angle sensor 13, and the cylinder discrimination signal G used as the reference signal for the discrimination of the cylinder, supplied through line 13*b* from the crankshaft angle sensor 13, are supplied to the control circuit CONT.

Figure 2:
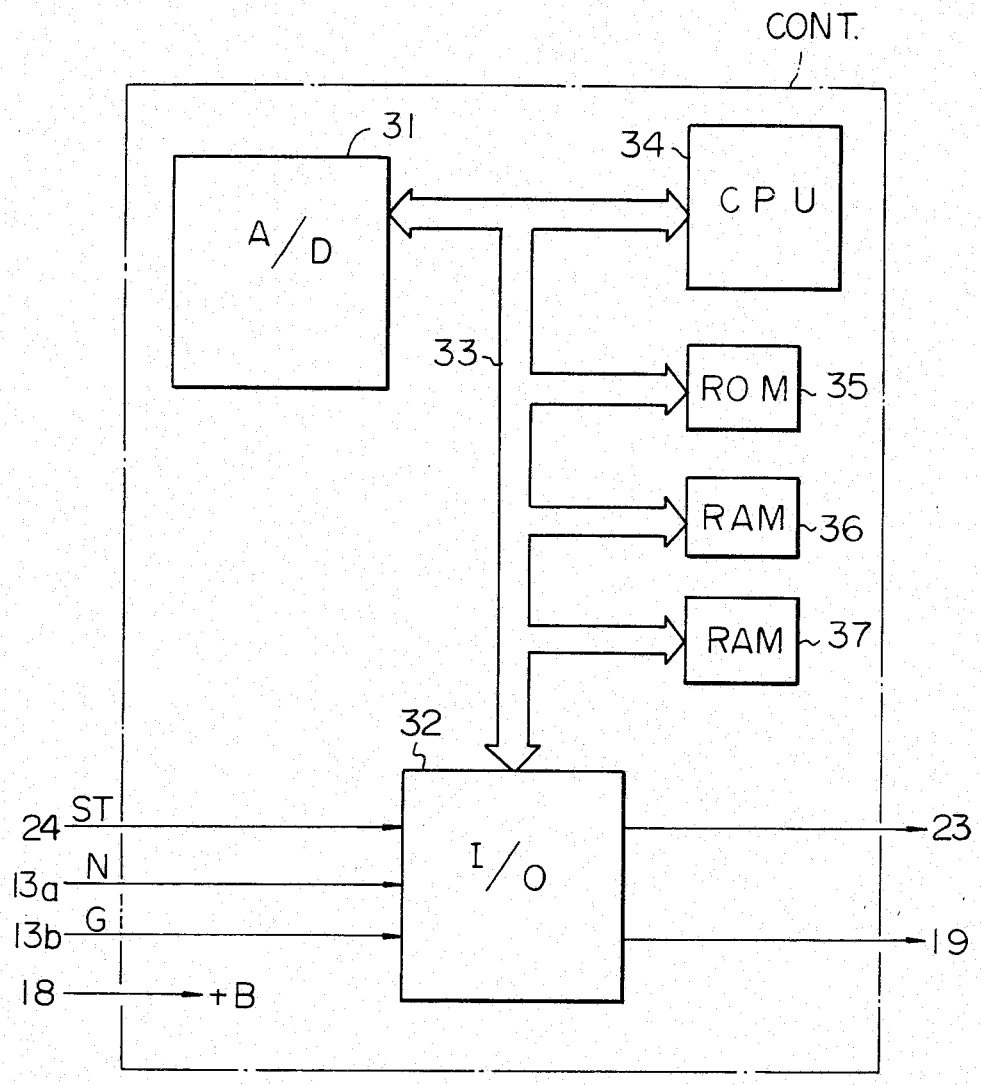
FIG. 2 illustrates the control circuit used in the apparatus of FIG. 1.

As illustrated in FIG. 2, the control circuit CONT of the apparatus of FIG. 1 includes an input/output circuit (I/O) 32 with a buffer, a bus line 33, a central processing unit (CPU) 34, a read-only memory (ROM) 35, and random-access memories (RAMs) 36 and 37. The I/O circuit 32 receives the signal ST of the starting of the starter 24, the crankshaft angle signal N corresponding to the rotational speed of the engine, and the signal cylinder discriminator G for the discrimination of the cylinder. The I/O circuit produces the signal for controlling ignition, which signal is supplied to the ignition coil 23, and the signal for controlling fuel injection, which signal is supplied to the fuel-injection valve 19.

In the operation of the control circuit CONT, control of the fuel injection is carried out by calculating the value of the output signal of the control circuit CONT on the basis of the crankshaft angle signal and the cylinder discrimination signal so that the first fuel injection is carried out in accordance with the first crankshaft angle signal after the starting of cranking.

The operation of the control circuit CONT of FIG. 2 will now be described. First, the starting of the starter 24 is detected and the detected signal is supplied to the control circuit CONT. Upon supply of the detected signal, the instruction which commands fuel injection for starting of the engine is issued, and a FLAG is established in a RAM by the operation of the CPU 34 in the control circuit CONT. In order to carry out this fuel injection for starting of the engine an operation to interrupt the main routine is carried out. This interruption operation is carried out as a routine in synchronization with the crankshaft angle signal N. In this interruption operation, first, it is checked whether or not a FLAG exists in a RAM so as to determine whether or not an instruction which commands fuel injection for starting of the engine exists.

If the result of checking indicates that there exists an instruction which commands fuel injection for starting of the engine, an injection for the starting is carried out once with a pulse width which is calculated according to a predetermined process. Then the FLAG for the instruction which commands fuel injection for starting of the engine is cancelled, and, hence, the interruption operation is completed.

Figure 3:
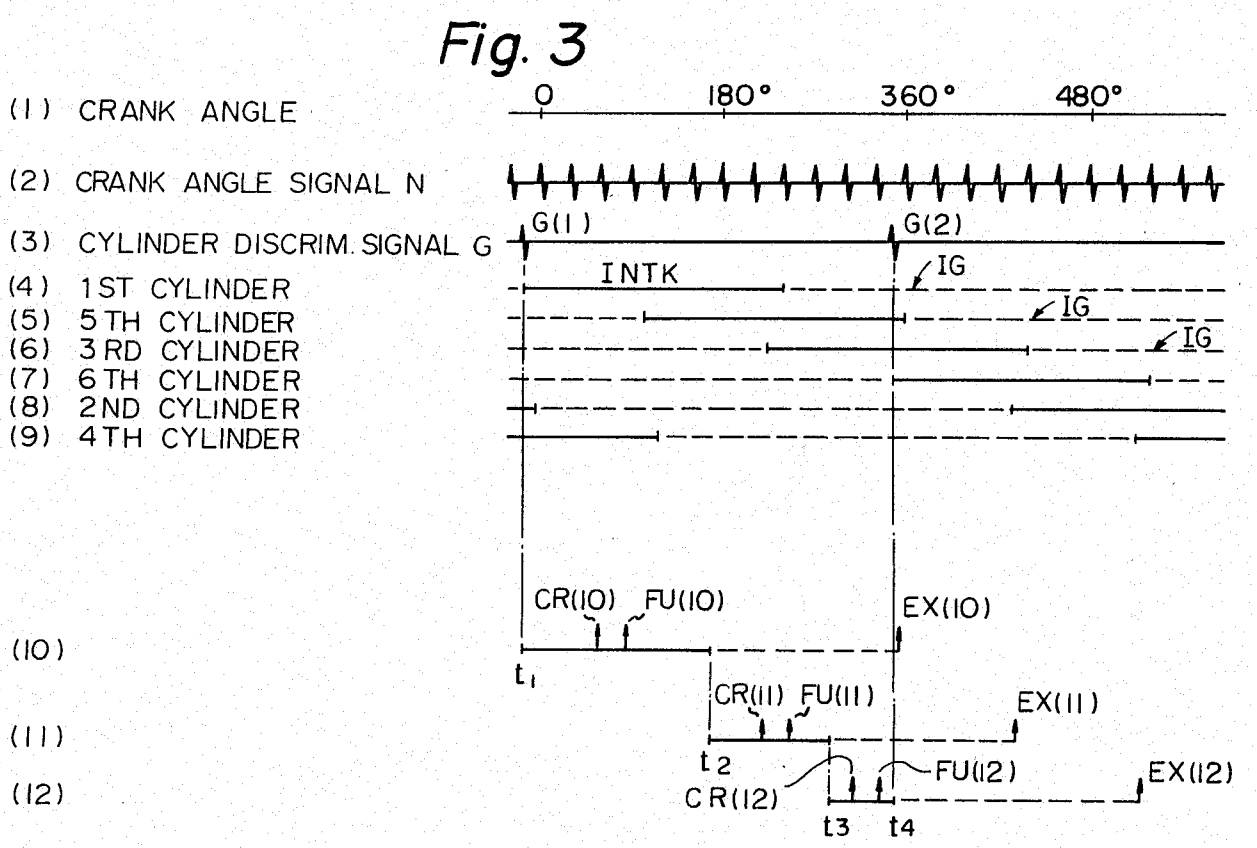
FIG. 3 illustrates the process of operation of the apparatus of FIG. 1.

The process of the operation of the apparatus of FIG. 1 is illustrated in FIG. 3. In FIG. 3, (1) the change of the crankshaft angle, (2) the signal N of the crankshaft angle, (3) the cylinder discrimination signal G, (4) the operation of the first cylinder, (5) the operation of the fifth cylinder, (6) the operation of the third cylinder, (7) the operation of the sixth cylinder, (8) the operation of the second cylinder, and (9) the operation of the fourth cylinder are illustrated. INTK indicates the air-intake process, and IG indicates the ignition timing.

Also in FIG. 3, (10), (11), and (12) illustrate the timing relationship between the starting of cranking CR, the first fuel injection FU, and the first explosion EX of the air-fuel mixture.

In the apparatus of FIG. 1, when engine cranking is started between two adjacent G signals, fuel injection is carried out in accordance with the first N signal after the starting of cranking. Accordingly, the first explosion of the air-fuel mixture can take place in the worst case after one rotation of the crankshaft.

Such a situation is illustrated in FIG. 3. When engine cranking CR(10) is started between t1 and t2, fuel injection FU(10) is carried out in accordance with the first N signal, and the explosion of the air-fuel mixture takes place at the timing EX(10). When engine cranking CR(11) is started between t2 and t3, fuel injection FU(11) is carried out in accordance with the first N signal, and the explosion of the air-fuel mixture takes place at the timing EX(11). When engine cranking CR(12) is started between t3 and t4, fuel injection FU(12) is carried out in accordance with the first N signal, and the explosion of the air-fuel mixture takes place at the timing EX(12).

Thus, as illustrated in FIG. 3, the period from the starting of cranking to the first explosion of the air-fuel mixture falls within $\frac{2}{3}$ of a rotation of the crankshaft. That is, the period is, at the longest, only 1 rotation of the crankshaft.

Figure 4:
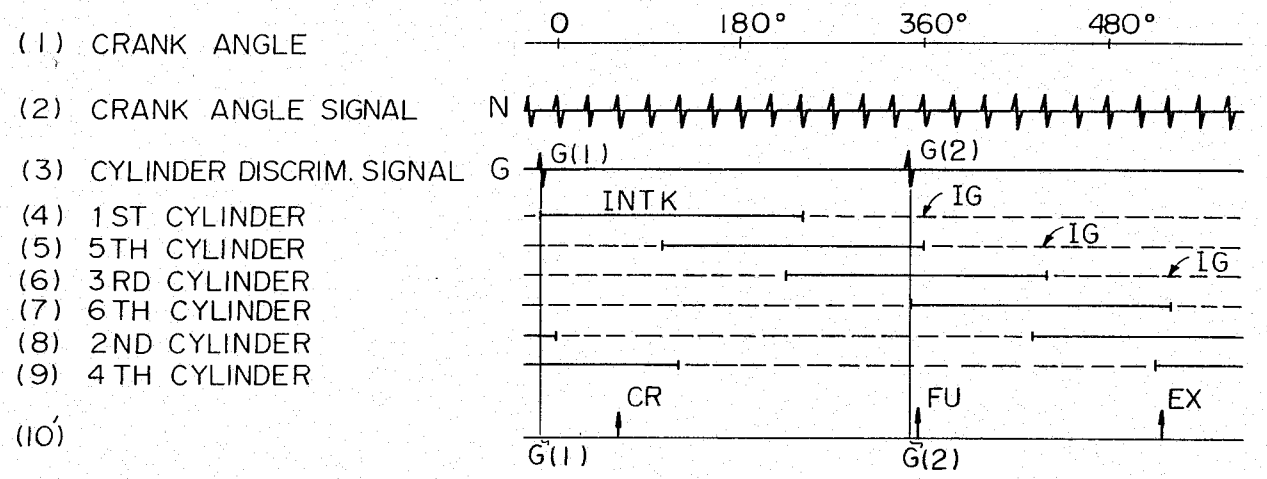
Fig. 4 PRIOR ART
FIG. 4 illustrates the process of operation of the prior art apparatus.

Contrary to this, the process of operation of the prior art apparatus is illustrated in FIG. 4. In FIG. 4, (1) through (9) are the same as (1) through (9) of FIG. 3. In FIG. 4, (10') illustrates the timing relationship between the starting of cranking CR, the first fuel injection FU, and the first air-fuel mixture explosion EX.

As illustrated in FIG. 4, when cranking CR is started between two adjacent G signals G1 and G2, the first fuel injection FU is carried out immediately after the signal G2, regardless of the timing of the starting of cranking between G1 and G2. Hence, the first explosion EX of the air-fuel mixture takes place at a predetermined period later than G2. Thus, the period from the starting of cranking to the first explosion of the air-fuel mixture falls within a $\frac{2}{3}$ rotation through $1\frac{2}{3}$ rotations of the crankshaft. Accordingly, FIG. 4 does not have the advantage of of FIG. 3, this advantage being that the period is, at the longest, only 1 rotation of the crankshaft.

Figure 5:
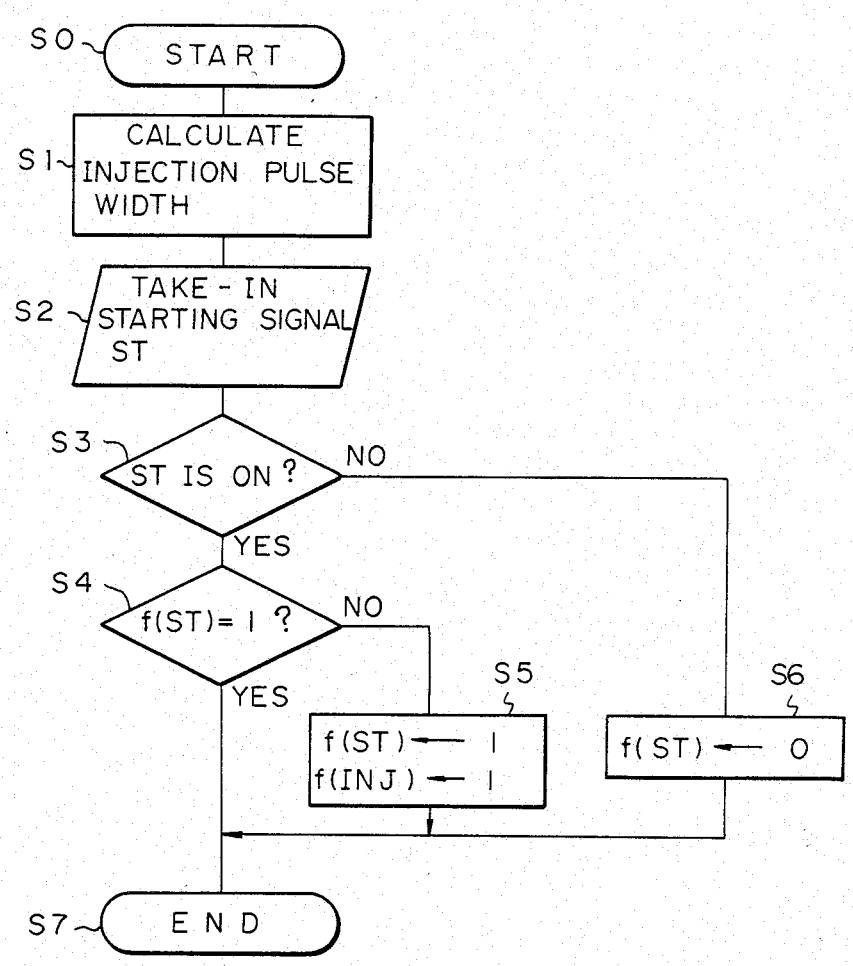
FIGS. 5 and 6 illustrate examples of the flow chart of the calculation function carried out by the control circuit of FIG. 2.
Figure 6:
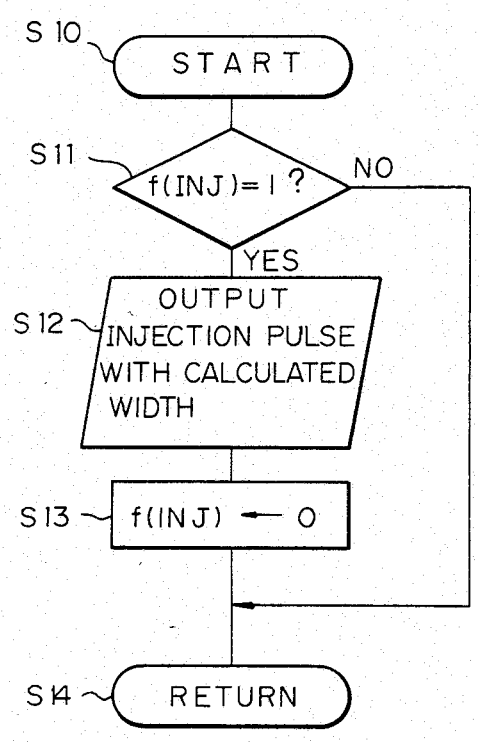

An example of the flow chart of the calculation routine carried out in the control circuit CONT of FIG. 2 is illustrated in FIGS. 5 and 6. The main routine S0 through S7 is illustrated in FIG. 5 while the interruption routine S10 through S14 is illustrated in FIG. 6. In step S0, calculation is started. In step S1, the pulse width for the starting of fuel injection is calculated and stored in a RAM. In step S2, the starting signal ST for the starter 24 is taken in. In step S3, it is decided whether or not the starting signal ST is ON.

If the decision of step S3 is NO, the process proceeds to step S6, where "0" is stored in the FLAG f(ST). If the decision of step S3 is YES, the process proceeds to step S4, where it is decided whether or not the FLAG f(ST) is "1".

If the decision of step S4 is NO, the process proceeds to step S5, where "1" is stored in the FLAG f(ST) in a RAM for the starting signal and "1" is also stored in the FLAG f(INJ) in a RAM for the fuel injection for starting the engine. Then the process proceeds to step S7. If the decision of step S4 is YES, the process proceeds directly to step S7. In step S7, the main routine is completed.

The interruption routine of FIG. 6 is carried out in synchronization with the crankshaft angle signal N. In step S10, the interruption routine is started, and this routine begins whenever the instruction to start fuel injection is made by the CPU (as suggested by the step S11 of FIG. 6). In step S11, it is decided whether or not the FLAG f(INJ) for the fuel injection for starting of the engine is "1". If the decision is YES, the process proceeds to step S12, where a single fuel injection for starting of the engine is carried out with a pulse having a calculated width. Then the process proceeds to step S13, where "0" is stored in the flag f(INT). Next, the process proceeds to step S14. If the decision of step S11 is NO, the process proceeds directly to step 14. In step S14, the process returns to the main routine.

We claim:

1. Aa method for controlling fuel injection in an internal-combustion engine, comprising the steps of:

producing crankshaft angle signals and cylinder discrimination signals with a crankshaft angle sensor, determining generation of a signal for execution of the first injection of fuel in response to the produced crankshaft angle signals and the produced cylinder discrimination signals, and performing the first injection of fuel in accordance with the first crankshaft angle signal after the starting of cranking of the engine in response to said determination so that the first explosion of the air-fuel mixture takes place within one rotation of the crankshaft of the engine.

2. A method as defined in claim 1, wherein said performing step includes a main routine to decide whether a starting signal is ON and whether a value of a FLAG of the starting signal is "1".

3. A method as defined in claim 2, wherein the operation of the main routine including deciding whether the value of the FLAG of the starting signal is "1" constitutes an interruption routine of said main routine.

4. An apparatus for controlling fuel injection in an internal-combustion engine, comprising:

fuel injection means for injecting fuel into said engine using a fuel injection valve;

starter means for producing a signal representing starting of the engine;

crankshaft angle sensor means for producing first signals representing the angle of a crankshaft of said engine and second signals representing discrimination of the cylinders of the engine; and control circuit means for receiving the signals from said starter means and said crankshaft angle sensor means, and in response thereto, generating a signal for commanding the fuel injection means to perform a first injection of fuel in accordance with the first crankshaft angle signal received after the starting of cranking of the engine, whereby the first injection of fuel and explosion thereof takes place within one rotation of said crankshaft.

* * * * *